US010500890B2

(12) United States Patent
Busam et al.

(10) Patent No.: US 10,500,890 B2
(45) Date of Patent: Dec. 10, 2019

(54) FLEXIBLE BINDING MECHANISM

(71) Applicant: ACCO Brands Corporation, Lake Zurich, IL (US)

(72) Inventors: Edward P. Busam, Mason, OH (US); Bobby G. James, Jr., Miamisburg, OH (US); Paul E. Olvera, Chicago, IL (US); Michael D. Rowe, Medway, OH (US)

(73) Assignee: ACCO Brands Corporation, Lake Zurich, IL (US)

( * ) Notice: Subject to any disclaimer, the term of this patent is extended or adjusted under 35 U.S.C. 154(b) by 343 days.

(21) Appl. No.: 15/192,100

(22) Filed: Jun. 24, 2016

(65) Prior Publication Data

US 2017/0001462 A1 Jan. 5, 2017

Related U.S. Application Data

(60) Provisional application No. 62/186,840, filed on Jun. 30, 2015.

(51) Int. Cl.
*B42D 3/06* (2006.01)
*B42F 13/02* (2006.01)
(Continued)

(52) U.S. Cl.
CPC ..... *B42F 13/10* (2013.01); *B42D 3/06* (2013.01); *B42D 3/126* (2013.01); *B42F 13/02* (2013.01); *B42F 13/06* (2013.01)

(58) Field of Classification Search
CPC ..... B42F 13/02; B42F 13/06; B42F 13/10
(Continued)

(56) References Cited

U.S. PATENT DOCUMENTS 1,755,604 A * 4/1930 Kline ..... B42F 13/06 281/17
2,042,366 A 12/1934 Swank
(Continued)

FOREIGN PATENT DOCUMENTS

CH 516411 12/1971
DE 1024922 B1 * 2/1958 ..... B42F 13/02
(Continued)

OTHER PUBLICATIONS

PCT, International Search Report and Written Opinion, International Application No. PCT/US2016/039168 (dated Oct. 12, 2016).
(Continued)

*Primary Examiner* — Kyle R Grabowski
(74) *Attorney, Agent, or Firm* — Fitch, Even, Tabin & Flannery LLP

(57) ABSTRACT

A binding mechanism including a body portion having a flange opening extending therethrough. The body portion further includes or at least partially defines a body portion opening positioned adjacent a base end of the flange. The binding mechanism has a manually deflectable flange coupled to the body portion. At least part of the flange is insertable through the flange opening from a first side of the body portion to at least partially form a loop on the first side of the body portion. The at least part of the flange is alternatively insertable through the flange opening from a second side of the body portion opposite the first side to at least partially form a loop on the second side of the body portion. The body portion opening is configured to receive the flange therethrough to enable the flange to be positioned on either the first side or the second side of the body portion.

29 Claims, 13 Drawing Sheets

(51) Int. Cl.
*B42F 13/06* (2006.01)
*B42F 13/10* (2006.01)
*B42D 3/12* (2006.01)

(58) Field of Classification Search
USPC ..... 402/8, 13, 15, 16
See application file for complete search history.

(56) References Cited

U.S. PATENT DOCUMENTS

| | | | | | |
|---|---|---|---|---|---|
| 2,133,069 | A | | 8/1935 | Williamson | |
| 2,329,786 | A | | 9/1943 | Ringler | |
| 2,559,556 | A | | 7/1951 | Ambler | |
| 2,575,583 | A | | 11/1951 | Clarke et al. | |
| 2,773,504 | A | * | 12/1956 | McGervey | B42F 13/04 402/74 |
| 2,911,977 | A | | 11/1957 | French | |
| 3,236,242 | A | | 2/1966 | Galiley | |
| 3,246,653 | A | | 4/1966 | Sexton | |
| 3,362,411 | A | | 1/1968 | Moller | |
| 3,362,412 | A | | 1/1968 | Moller | |
| 3,516,755 | A | * | 6/1970 | Smith | B42F 13/02 402/9 |
| 3,834,824 | A | * | 9/1974 | Jahn | B42F 13/02 24/16 PB |
| 3,850,488 | A | | 11/1974 | Elias et al. | |
| 3,950,107 | A | | 4/1976 | Seaborn | |
| 3,956,798 | A | * | 5/1976 | Wright | B42B 5/10 281/27.1 |
| 4,135,832 | A | * | 1/1979 | Saltz | B42F 13/06 402/15 |
| 4,174,909 | A | | 11/1979 | Jahn | |
| 4,192,620 | A | | 3/1980 | Jahn | |
| 4,256,411 | A | | 3/1981 | Podosek | |
| 4,261,664 | A | | 4/1981 | Crawford | |
| 4,437,781 | A | * | 3/1984 | Weihe | B42F 13/02 402/8 |
| 4,784,507 | A | | 11/1988 | Vetter | |
| 4,856,926 | A | | 8/1989 | Hirsch | |
| 4,940,352 | A | * | 7/1990 | Kratzert | B42F 13/10 402/13 |
| 5,167,463 | A | | 12/1992 | Corbishley | |
| 5,423,624 | A | | 6/1995 | Richards | |
| 5,618,122 | A | | 4/1997 | Constantine | |
| 5,827,003 | A | | 10/1998 | Konig | |
| 6,168,337 | B1 | * | 1/2001 | Adams | B42F 13/06 24/16 PB |
| 6,394,684 | B2 | | 5/2002 | Kapur et al. | |
| 6,435,753 | B1 | | 8/2002 | Gusack | |
| 6,655,868 | B2 | | 12/2003 | Drew | |
| 6,796,738 | B2 | | 9/2004 | Dengler | |
| 7,198,422 | B2 | | 4/2007 | Ng et al. | |
| 2001/0051069 | A1 | | 12/2001 | Youngs et al. | |
| 2002/0023553 | A1 | | 2/2002 | Rebora | |
| 2003/0077108 | A1 | | 4/2003 | Menahem | |
| 2010/0196082 | A1 | | 8/2010 | Harris et al. | |

FOREIGN PATENT DOCUMENTS

| | | | | | |
|---|---|---|---|---|---|
| DE | 1229498 | | | 12/1966 | |
| DE | 1436185 | | | 10/1968 | |
| DE | 7223755 | | | 11/1972 | |
| DE | 2206662 | A1 | * | 8/1973 | B42F 13/02 |
| DE | 2308905 | A1 | * | 9/1974 | B42F 13/02 |
| DE | 2517208 | | | 10/1976 | |
| DE | 2365970 | | | 2/1977 | |
| DE | 2612625 | | | 9/1977 | |
| DE | 2947609 | | | 5/1981 | |
| DE | 3232986 | | | 11/1983 | |
| DE | 3511304 | | | 10/1986 | |
| DE | 8702107 | | | 4/1987 | |
| DE | 29712982 | | | 11/1997 | |
| EP | 0517108 | | | 12/1992 | |
| EP | 1036670 | A2 | * | 9/2000 | B42F 13/02 |
| FR | 2592838 | | | 7/1987 | |
| FR | 2614841 | | | 11/1988 | |
| FR | 2650538 | | | 2/1991 | |
| GB | 919032 | | | 2/1963 | |
| GB | 1209770 | | | 10/1967 | |
| GB | 2213432 | | | 8/1989 | |
| GB | 2213432 | A | * | 8/1989 | B42F 13/10 |
| JP | S48-30523 | | | 4/1973 | |
| JP | 04-153098 | | | 5/1992 | |
| JP | 4-98187 | | | 8/1992 | |
| JP | 4-98188 | | | 8/1992 | |
| JP | 6-7979 | | | 2/1994 | |
| JP | 6-34982 | | | 5/1994 | |
| JP | 07-96695 | | | 4/1995 | |
| JP | 09-156273 | | | 6/1997 | |
| JP | 10-058881 | | | 3/1998 | |
| JP | 3049083 | | | 3/1998 | |
| JP | 10-100577 | | | 4/1998 | |
| KR | 20-0232907 | | | 10/2001 | |
| KR | 10-1211785 | | | 12/2012 | |
| WO | 96/22888 | | | 8/1996 | |

OTHER PUBLICATIONS

Kokuyo Binder (Jan. 2005).

* cited by examiner

FLEXIBLE BINDING MECHANISM

This application claims priority to U.S. Provisional Patent Application Ser. No. 62/186,840 filed on Jun. 30, 2015, the entire contents of which are hereby incorporated by reference.

BACKGROUND

Binding mechanisms can be used to bind loose leaf papers and the like to pockets, notebook, portfolios, binders, etc. One type of binding mechanism takes the form of relatively thin, deflectable metal prongs which can extend through the hole of the sheet item, and then be bent or deflected to retain the sheet item in place. However, the metal prongs can fatigue with repeated use, causing them to weaken or break off. In addition, such prong-style binding mechanisms typically hold the bound sheets tight to the underlying cover, and therefore the sheets do not lie flat when folded back over the binding mechanism, which makes it difficult to view underlying sheets. Finally, the metal prongs can be relatively short, thereby limiting the capacity of the associated binding device.

SUMMARY

In one embodiment the present invention is a binding mechanism including a body portion having a flange opening extending therethrough. The body portion further includes or at least partially defines a body portion opening positioned adjacent a base end of the flange. The binding mechanism has a manually deflectable flange coupled to the body portion. At least part of the flange is insertable through the flange opening from a first side of the body portion to at least partially form a loop on the first side of the body portion. The at least part of the flange is alternatively insertable through the flange opening from a second side of the body portion opposite the first side to at least partially form a loop on the second side of the body portion. The body portion opening is configured to receive the flange therethrough to enable the flange to be positioned on either the first side or the second side of the body portion.

DETAILED DESCRIPTION

Figure 1:
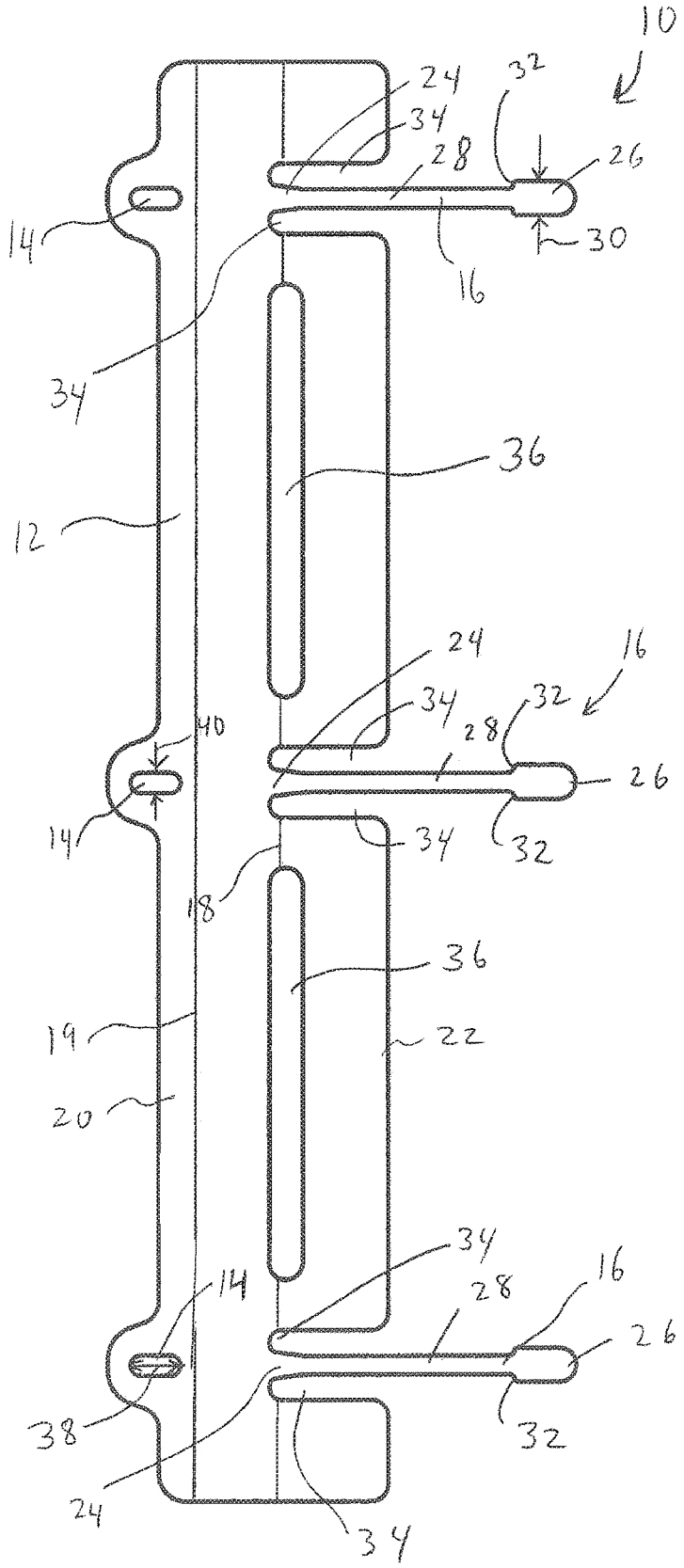
FIG. 1 is a top view of one embodiment of the binding mechanism of the present invention.

With reference to FIG. 1, in one embodiment a binding mechanism, generally designated 10, includes a generally rectangular body or body portion 12 with a set of flange openings 14 formed therethrough. A set of flanges 16 are coupled to, or form part of, the body 12. In one embodiment the body 12 (including the flanges 16) is made of a single, seamless unitary or integral piece of material that is generally flat, planar and sheet-like, and can be made of a variety of materials, including plastic or polymers, such as polypropylene or polyethylene. The body 12 can be relatively thin, such as having a thickness of about 0.5 mm in one case, or less than about 1 mm in another case.

In one embodiment the body 12 includes binding mechanism hinge line 18 extending therealong, dividing the body 12 into a first or free portion 20, and a second or attachment portion 22. However, in some cases the binding mechanism hinge line 18 is optional, or may not necessarily be preformed in the binding mechanism 10 but can in some cases be formed during natural use of the binding mechanism 10, as will be described in greater detail below. The body 12 can also optionally include a crease line 19 (shown in FIGS. 1 and 2) formed in the free portion 20, for purposes which will be described below.

Each flange 16 can be coupled to the body 12 and/or free portion 20. Each flange 16 includes a base or connecting portion 24, a tip portion 26 at or adjacent to a distal end thereof, and a stem portion 28 positioned between the tip portion 26 and the base portion 24. Each tip portion 26 can have a greater width than the associated stem portion 28 (in a direction perpendicular to a length of the stem portion 28, and in a plane of the body 12), and can have a maximum width 30. A base end of each tip portion 26 can include and/or be defined by a stop surface or surfaces 32 extending generally perpendicular to the length of the stem portion 28.

Each stem portion 28 has a generally uniform width in the illustrated embodiment, but can have a variable width if desired. The base portion 24 of each flange 16 can in some cases have a greater width than the stem portion 28, or flare out at its end, to enable the flange 16 to be securely coupled to the free portion 20/base 12.

The body 12 can include or at least partially define a set of notches, body openings or cut-outs 34 positioned adjacent the base portion 24 and/or stem 28 of each flange 16 to provide clearance on either side of the flange 16, enabling free movement of the flange 16. In the illustrated embodiment each notch 34 is positioned in both the attachment portion 22 and the free portion 20, and each notch 34 is therefore positioned or extends on both sides of the binding mechanism hinge line 18. The body 12 can also include a set of longitudinal slots 36 formed therethrough and extending along a length thereof to provide material savings and/or improve flexibility of the body 12 along the hinge line 18. In some cases the longitudinal slots 36 can be considered to be part of the hinge line 18.

The body 12 and/or free portion 20 can include the set of openings 14 formed therethrough. In one embodiment each opening 14 is aligned with a corresponding flange 16 in a direction along a length of the flange 16. Each opening 14 can be eccentric or non-circular having a maximum width portion 38 extending thereacross and a minimum width portion 40 extending thereacross. The maximum width portion 38 of each opening 14 can have a width about equal to or larger than the maximum width 30 of the associated tip portion 26, and the minimum width portion 40 of each opening 14 can be smaller than the maximum width 30 of the associated tip portion 26.

Figure 2:
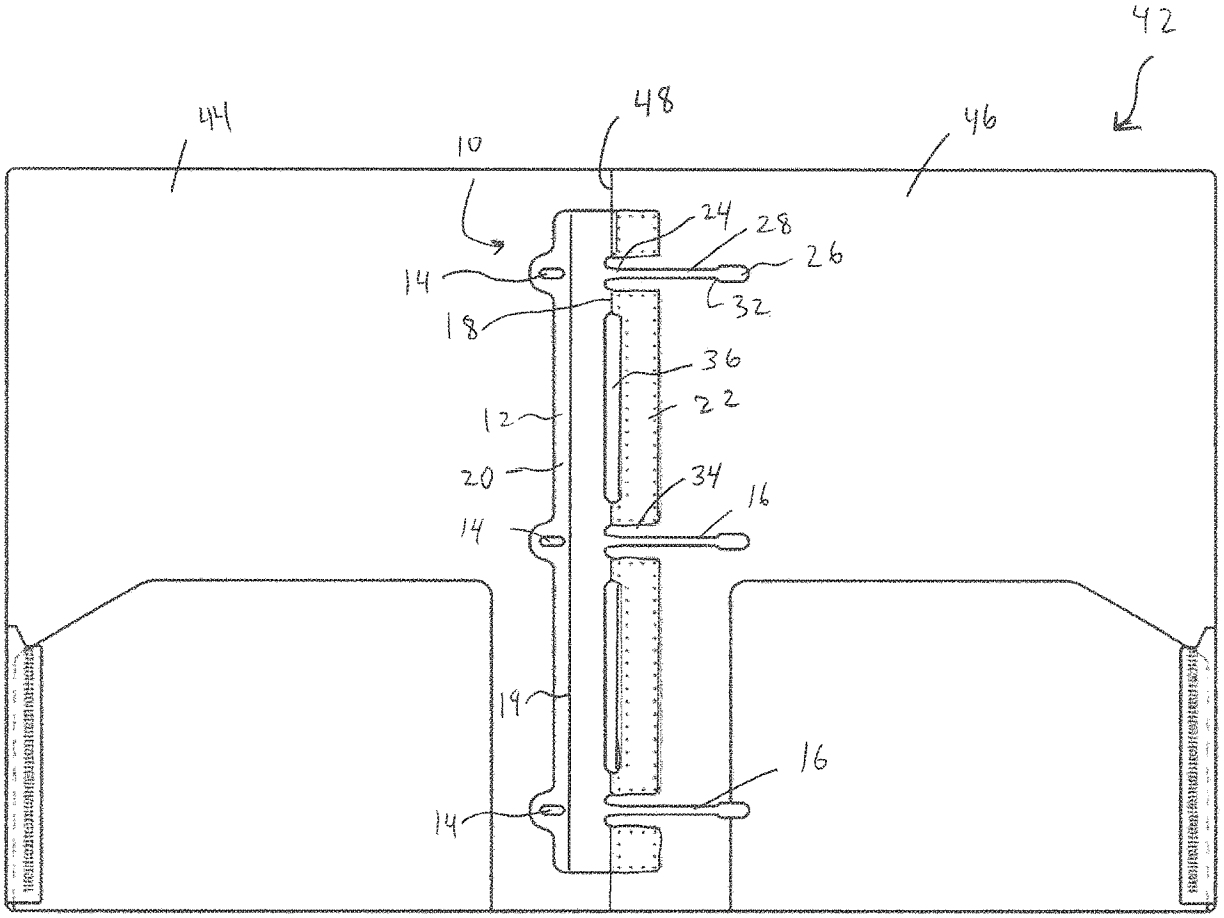
FIG. 2 is a top view of a storage pocket with the binding mechanism of FIG. 1 coupled thereto.

In one embodiment the binding mechanism 10 can be coupled to or form part of a storage device 42, such as a storage pocket shown in FIG. 2. The storage device 42 can be a separate component from the binding mechanism 10 and made from a separate piece of material or materials. In one embodiment the storage pocket 42 includes a front cover or panel 44 and a rear cover or panel 46 hingedly coupled to the front cover 44 along a storage device hinge line 48. The front 44 and rear 46 covers can be generally the same size and shape (rectangular in the illustrated embodiment), and each can have a surface area greater than a surface area of the body 12. The binding mechanism 10 can be coupled to an inner surface of the storage pocket 42, and is coupled to the rear cover 46 in the embodiment of FIG. 2 by securing the attachment portion 22 to the rear cover 46, such as by welding or the other means.

Figure 5:
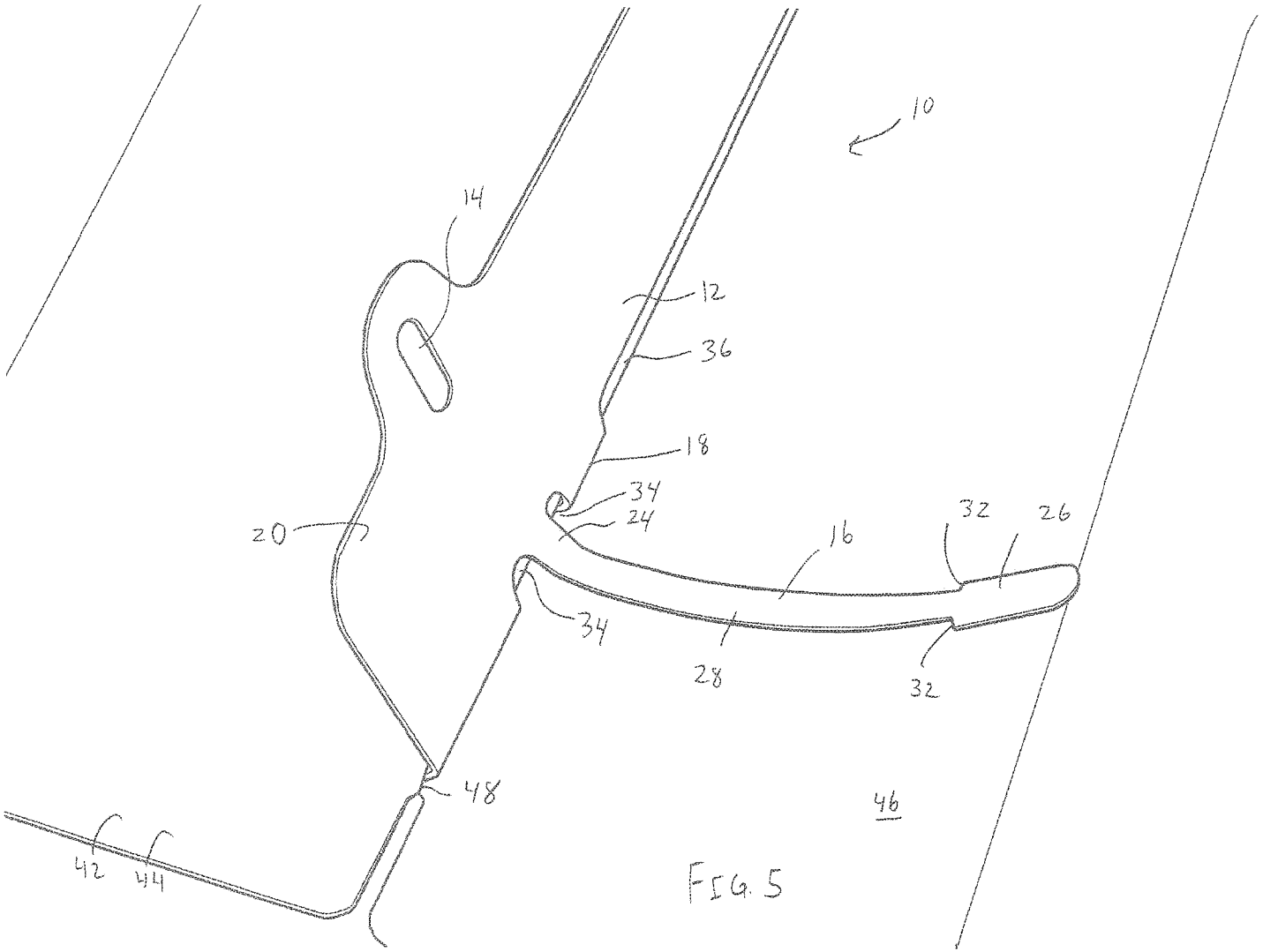
FIG. 5 is a perspective view of part of the storage pocket and binding mechanism of FIG. 3, with the flange positioned on an opposite side from that shown in FIG. 3.

In this case, the attachment portion 22 is coupled to the storage device 42, and the free portion 20 is not coupled to the storage device 42 and is free to pivot away from/relative to the storage device 42, including away from the front 44 and rear 46 covers and the attachment portion 22, as shown for example in FIG. 5. If the binding mechanism 10 includes the binding mechanism hinge line 18, the free portion 20 can pivot about the binding mechanism hinge line 18. On the other hand, if the binding mechanism 10 lacks the binding mechanism hinge line 18, the free portion 20 can pivot about a naturally-forming pivot area, such as a crease that may naturally form with sufficient usage/flexing.

The binding mechanism 10 can be coupled to the storage device 42 such that the binding mechanism hinge line 18 is parallel or generally parallel with and/or aligned or generally aligned with the storage device hinge line 48. In particular, the hinge lines 18, 48 may be aligned, or if offset, then offset by no more than about 5% in one case, or 10% in another case, of a width of one of the front 44 or rear 46 covers (i.e. in a direction perpendicular to the hinge lines 18, 48). This arrangement helps to enable any sheet items bound by the binding mechanism 10 are effectively stored in and protected by the storage device 42.

Figure 3:
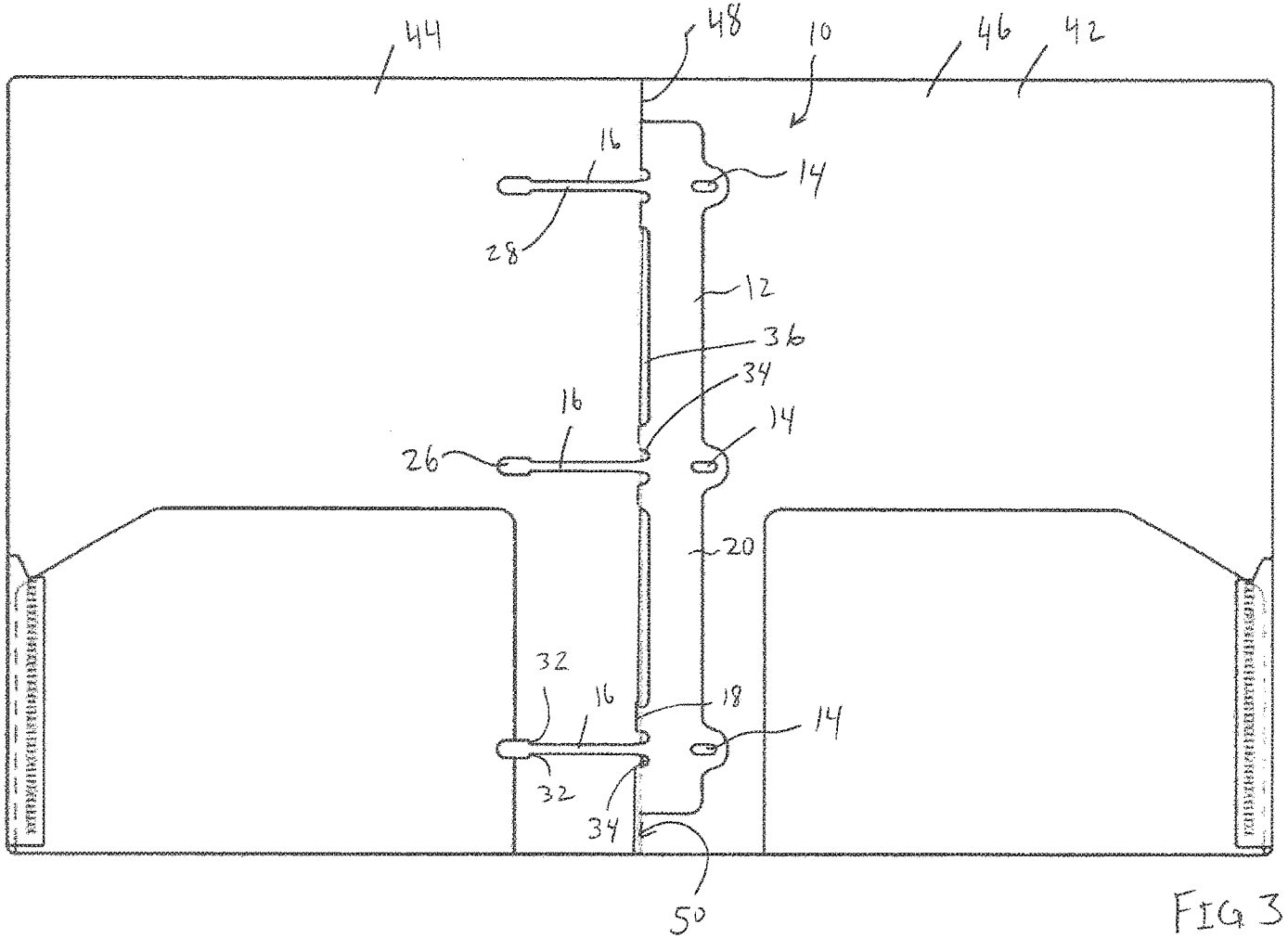
FIG. 3 is a top view of another storage pocket with the binding mechanism of FIG. 1 coupled thereto.
Figure 4:
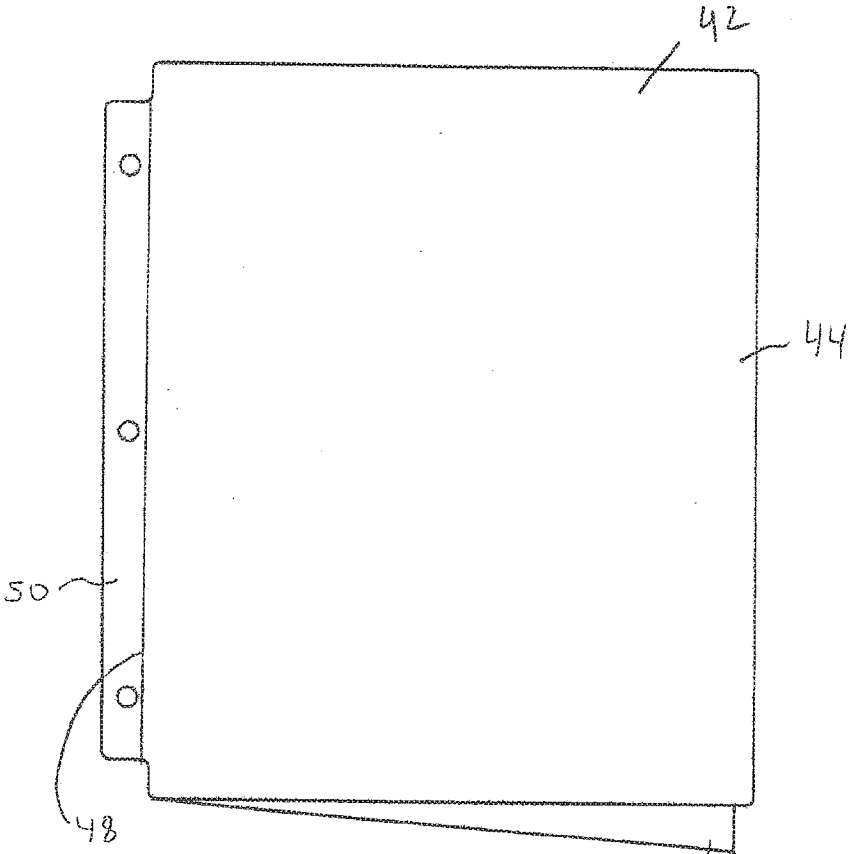
FIG. 4 is a top view of the storage pocket of FIG. 3, shown in a nearly-closed position.
Figure 9:
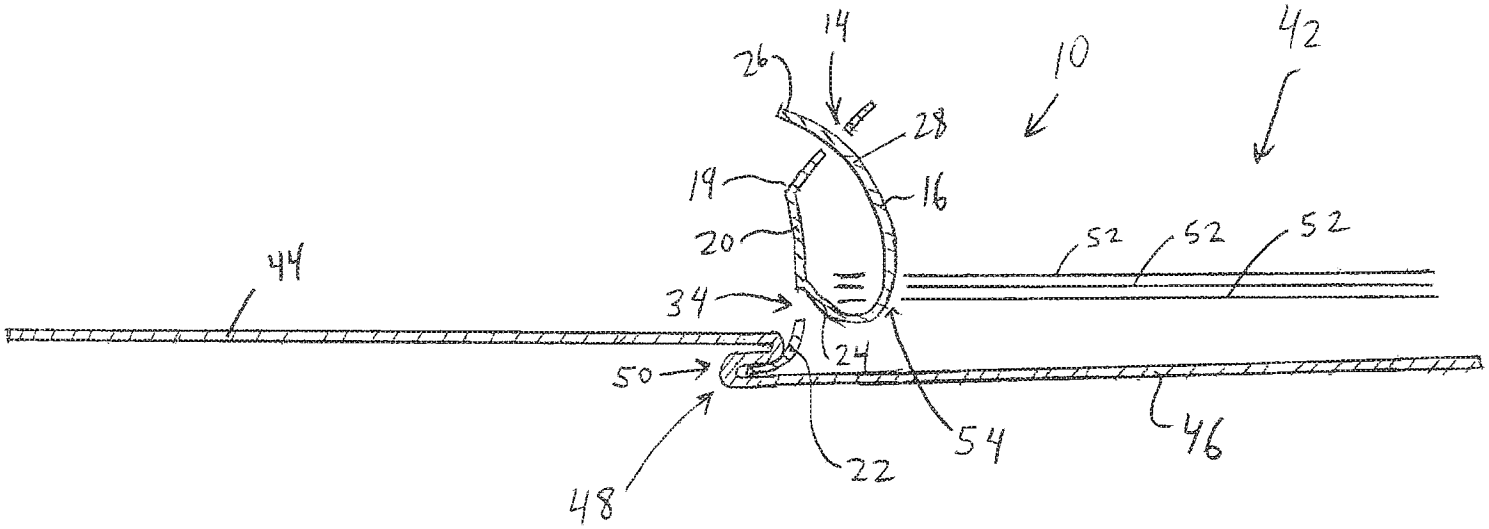
FIG. 9 is a schematic side cross section of the storage pocket and binding mechanism of FIG. 8.

In the embodiment of FIG. 2, the attachment portion 22 is coupled to an inner surface of the rear cover 46 and the flanges 16 extend to the right toward the center of rear cover 46. However, if desired the orientation of the binding mechanism 10 can be reversed and the attachment portion 22 can be coupled to an inner surface of the front cover 44 such that the flanges 16 extend to the left toward the center of the front cover 44 in FIG. 2. In a further alternative embodiment, as shown in the embodiment of FIGS. 3, 4 and 9, the storage device 42 can include a rearwardly-extending, two-ply spine portion 50. In this case the attachment portion 22 can be positioned in the spine portion 50 and coupled thereto. Moreover, in the embodiment of FIGS. 3 and 4 the flanges 16 extend to the left, toward the center of the front cover 44, although this configuration could also be reversed.

Figure 6:
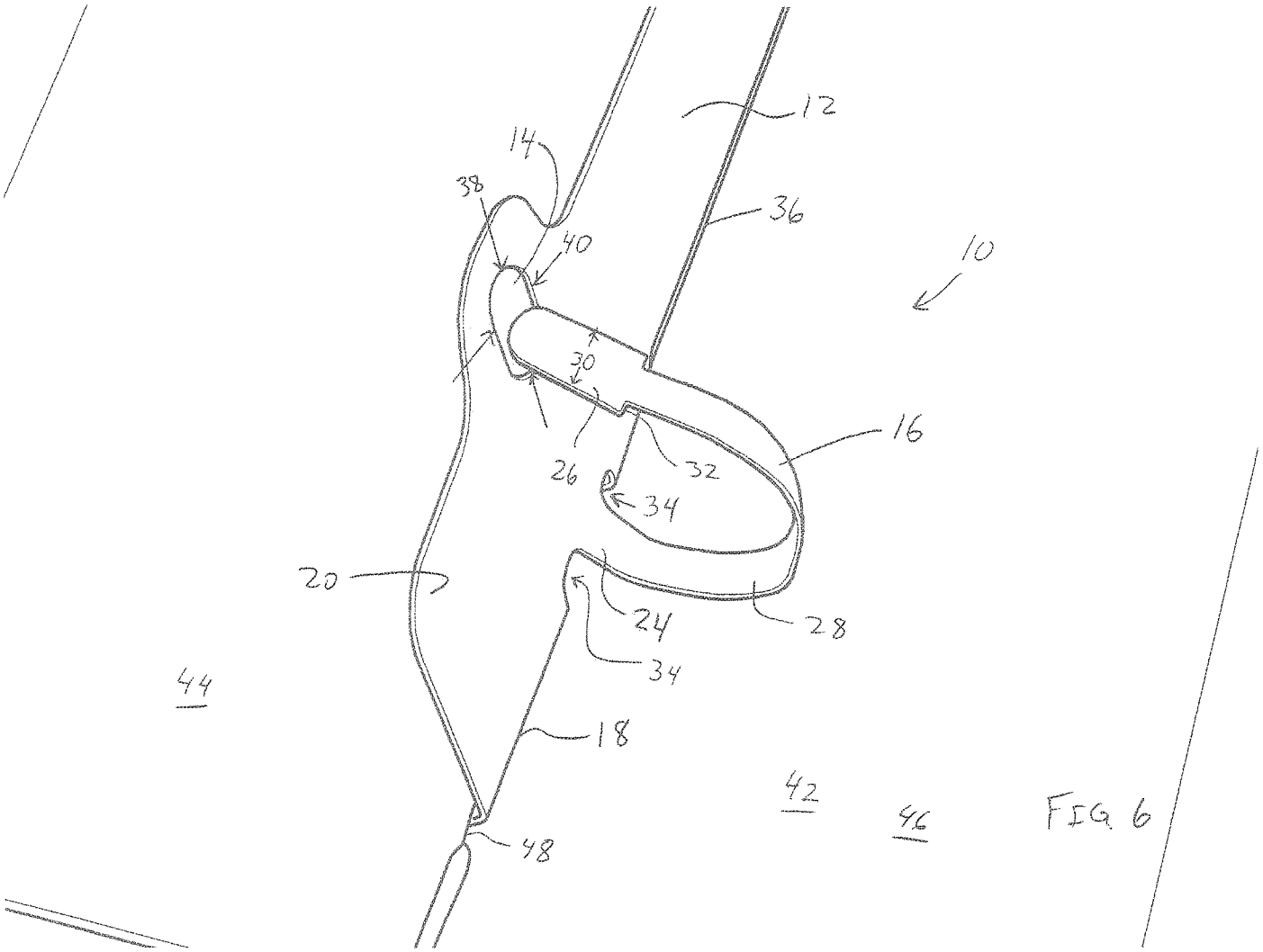
FIG. 6 is a perspective view of the storage pocket and binding mechanism of FIG. 5, with the flange moved adjacent to its associated opening.

In order to utilizing the binding mechanism 10, a sheet item or items, such as sheets of paper 52 (FIGS. 8, 9, 12 and 13), having holes 54 that align with the spacing of the flanges 16, can be provided. The flanges 16 can be positioned as shown in FIG. 5, extending away from the hinge lines 18, 48 toward the rear cover 46 and positioned on a first side (the rear cover side, in the illustrated embodiment) of the base 12/binding mechanism 10. Each flange 16 is then passed through the holes 54 of the sheet item 52, and curled about an axis extending along a length of the binding mechanism 10 so that each flange 16 is positioned immediately adjacent the associated opening 14, as shown in FIG. 6. As outlined above, each flange 16 can be made of a relatively thin, flexible material such that each flange 16 is manually deflectable/deformable into the "C" shape or semi-circular shape as shown.

Figure 7:
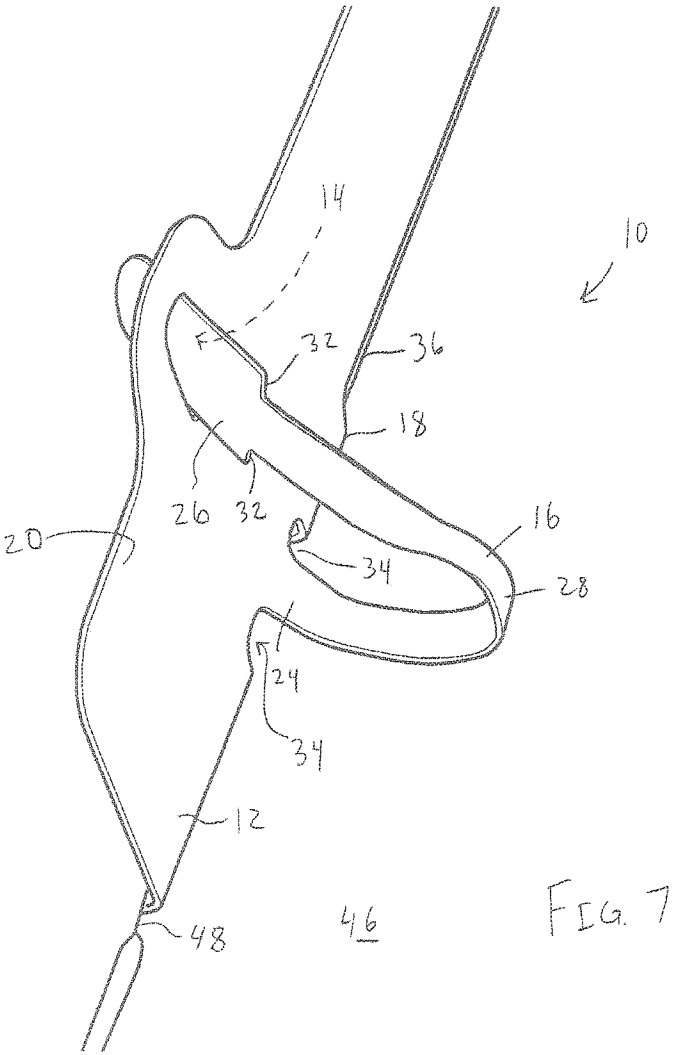
FIG. 7 is a perspective view of the storage pocket and binding mechanism of FIG. 6, with the flange twisted and inserted into the opening.

As outlined above, the tip portion 26 of each flange 16 may have a maximum width 30 that is greater than a minimum width portion 40 of the associated opening 14. Each flange 16 may lie in its flat position as shown in FIG. 6 in the absence of outside twisting forces such that the maximum width 30 of the flange 16 is aligned with the minimum width portion 40 of the opening 14 (or is not aligned with the maximum width portion 38 of the opening 14). Thus, in order for each flange 16 to pass through an associated opening 14, each flange 16 may need to be manually twisted such that the maximum width 30 of the tip portion 26 is misaligned with the minimum width portion 40 of the associated opening 14; and in one case the maximum width 30 of the tip portion 26 must be aligned with the maximum width portion 38 of the associated opening 14 to pass therethrough. In one case, then, each flange 16/tip portion 26 can be manually twisted about 90 degrees about an axis extending along a length of the flange 16, such that each tip portion 26 can enter and then be passed through an associated opening 14, as shown in FIG. 7. The shape and nature of material of the flanges 16, as described above, enables each flange 16 to be manually twisted as described and shown herein.

Figure 8:
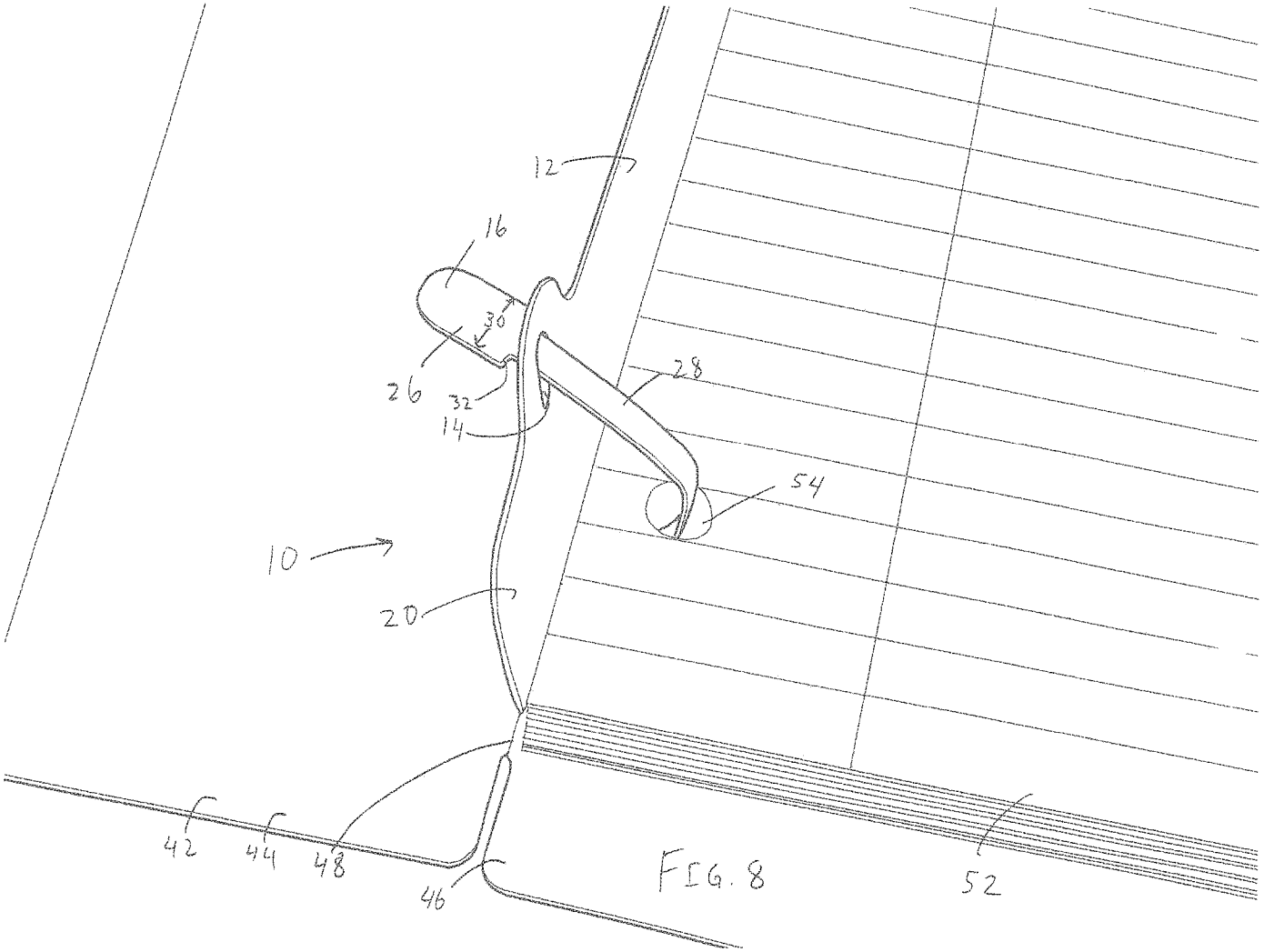
FIG. 8 is a perspective view of the storage pocket and binding mechanism of FIG. 7, with the flange fully inserted through the opening and untwisted, and binding a set of papers.

Once each tip portion 26 is entirely received or passed through an opening 14, the flange 16 can be released. The flange 16/tip portion 26 may then automatically untwist and return to its normal flat, or near flat position, as shown in FIG. 8. In this case the maximum width 30 of the tip portion 26 is again aligned with a minimum width portion 40 of the associated opening 14 (and/or misaligned with the maximum width portion 38 of the opening 14) to block the flange 16 from being pulled back through the opening 14. Each flange 16/tip portion 26 is thereby secured in place in its closed loop configuration where the flange 16 forms a loop with the free portion 20 of the base 12 (see also FIG. 9). As shown in FIG. 9, the crease line 19 in the free portion 20, if utilized, enables the free portion 20 to flex into the desired position to receive the flanges 16 and form the closed loops. The stop surface(s) 32 can engage the base 12 adjacent the opening 14 to prevent the flange 16 from being pulled back through the opening 14.

When it is desired to decouple the sheet items 52 and/or release the flanges 16, each flange 16/tip portion 26 can be twisted until the tip portion 26 can be retracted through the associated opening 14 and then released. Each flange 16 will then return to a flat or near-flat configuration as shown in FIG. 5, and is ready to bind further sheet items if desired.

Figure 10:
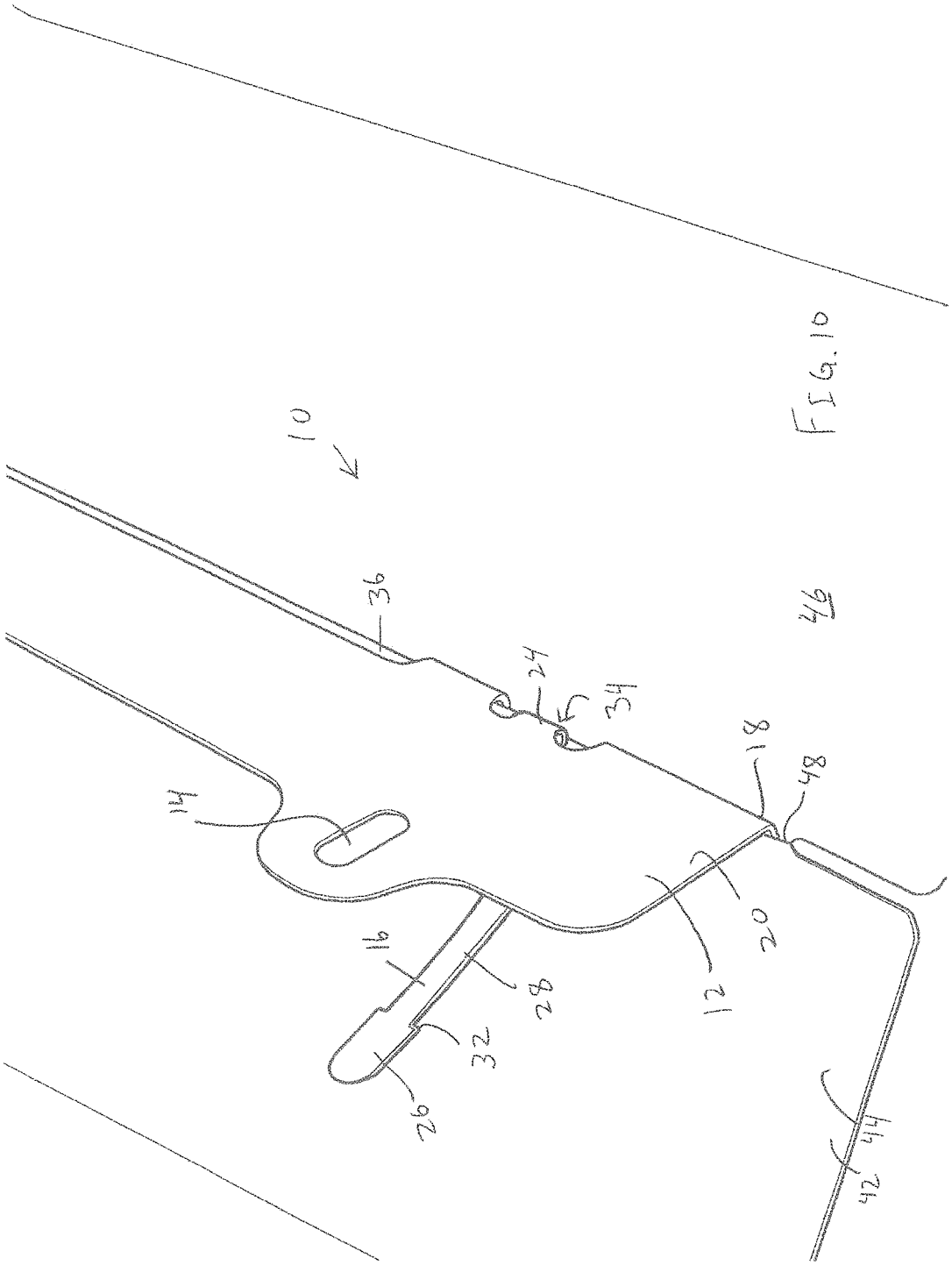
FIG. 10 is a perspective view of the storage pocket and binding mechanism of FIG. 5, with the flange positioned on an opposite side of the binding mechanism.
Figure 11:
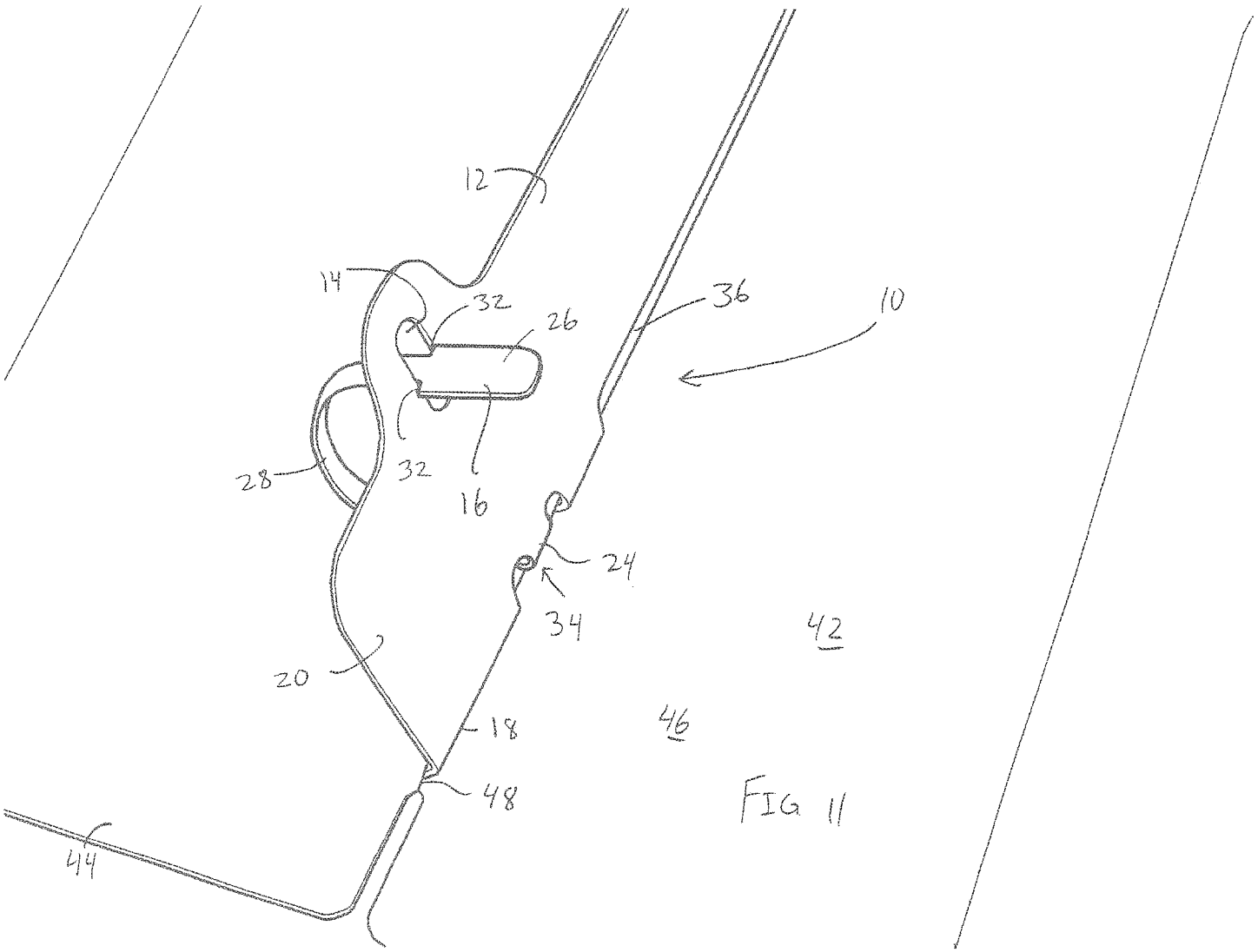
FIG. 11 is a perspective view of the storage pocket and binding mechanism of FIG. 10, with the flange inserted through the associated opening.
Figure 12:
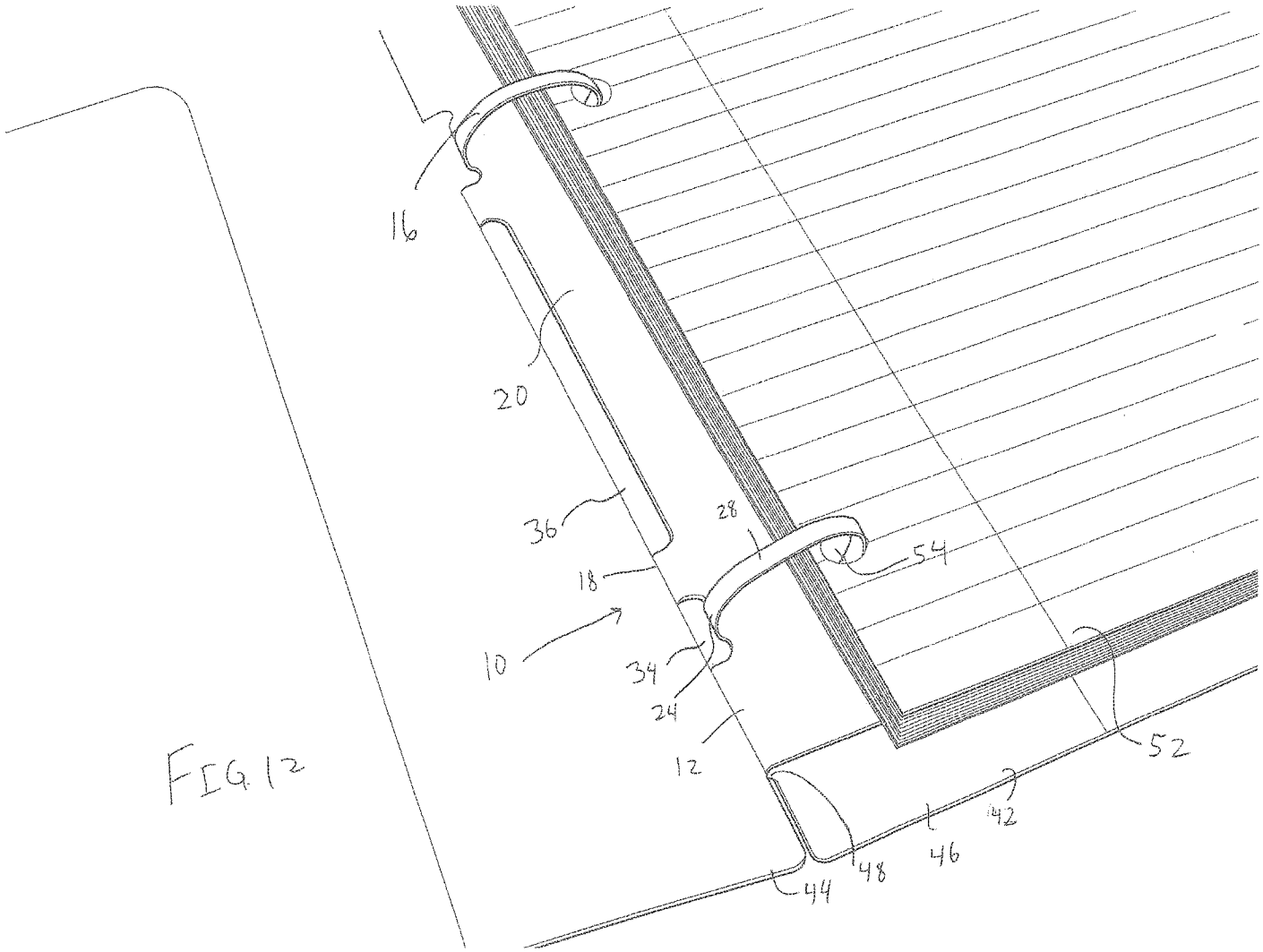
FIG. 12 illustrates the storage pocket and binding mechanism of FIG. 11, binding a set of papers and lying flat against the rear cover.
Figure 13:
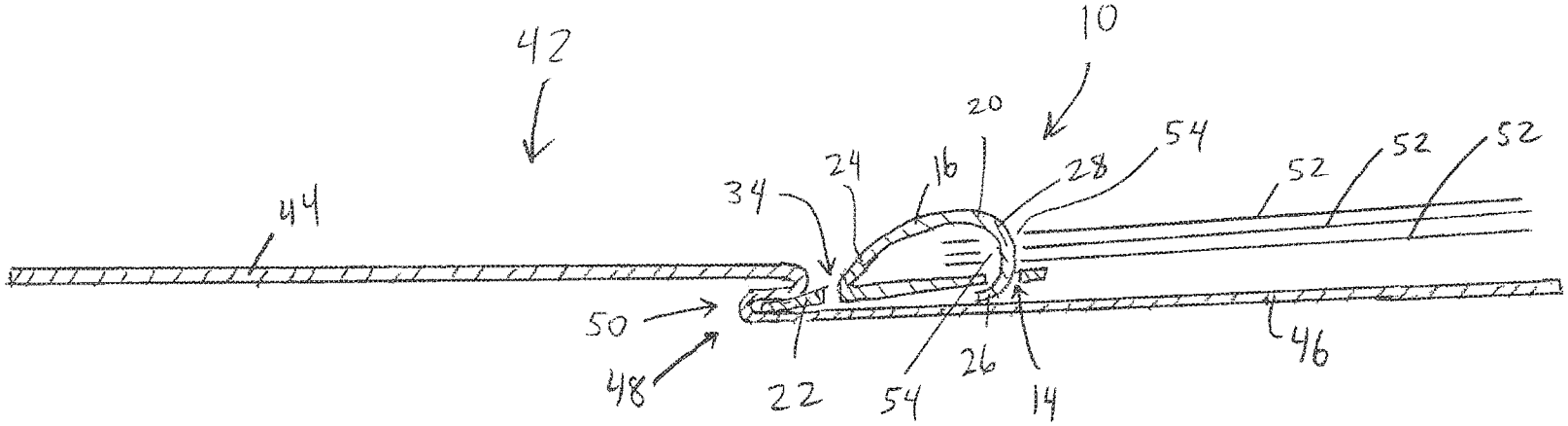
FIG. 13 is a schematic side cross section of the storage pocket and binding mechanism of FIG. 12.

As shown in FIGS. 5-9, each flange 16/loop can be positioned on a first side of the hinges 18, 48/body 12, and are shown therein on the rear cover 46 side. However, if desired some or all of the flanges 16 can be positioned a second opposite side of the hinges 18, 48/body 12, on the front cover 44 side. In order to position the flanges 16 on the second side, each flange 16 can be passed through the associated notch 34, which forms an opening or passageway with the storage device 42. Thus each notch/passageway 34 may have a surface area or size sufficient to allow each flange 16, including any enlarged tip portion 26, to pass therethrough, as shown in FIG. 10 as compared to FIG. 5. Once the flanges 16 are positioned on the second side, the flanges 16 can be operated in substantially the same manner as described above to form loops and bind items on the second side of the binding mechanism 10, as shown in FIG. 11. Each flange 16 is passable through the associated notch 34 below the associated opening 14 such that when each flange 16 forms a closed loop each flange 16 does not extend across the distal end of the free portion 20 or around a side edge thereof, and extends across the hinge line 18, if at all, at most a single time.

When sheet items 52 are bound by the closed loops, the sheet items 52 may be pivotable about the loops and be able to be positioned adjacent to and lie flat against either the front 44 and rear 46 covers (FIG. 12), as desired. The sheet items 52 can lie flat whether the sheet items 52 lie against the front cover 44, or rear cover 46, or with some sheet items 52 against the front cover 44 and some against the rear cover 46. In addition, since the flanges 16 are slidably received through the openings 14, if greater storage capacity is needed, additional portions of the flange 16 can automatically slide through the openings 14, thereby automatically increasing the size of the loops as needed. The material of the binding mechanism 10 can also provide a durable binding mechanism 10 without sharp edges.

The reversible nature of the flanges 16 provides significantly enhanced utility to the binding mechanism 10, enabling items to be bound on either side of the binding mechanism 10. For example, the flanges/loops can be formed on a first side of the hinge lines 18/48 or a second side thereof; or can be positioned adjacent either the front cover 44 or rear cover 46. In addition, if desired some flanges 16 can be positioned on one side of the binding mechanism 10, and other flanges 16 positioned on the other side at the same time, so that items can be simultaneously bound to the binding mechanism 10 on both sides thereof.

In the embodiments shown and described herein the storage device 42 takes the form of the storage pocket. However, the storage device 42 can take any of a wide variety of other forms or formats, such as binders, notebooks, portfolios, paper pads, report covers, filers, etc. In addition, although the storage pocket 42 is shown as including both a front cover 44 and a rear cover 46, in some cases the storage device/storage pocket 42 may include only a single cover/panel, and the binding mechanism 10 is coupled to the single cover/panel. Further alternatively, if desired the binding mechanism 10 can be used as a standalone component as shown for example in FIG. 1, and not be coupled to any storage device. It should also be understood that the embodiments shown here illustrate a binding mechanism 10 with three flanges 16 and three openings 14. However, any number of flanges 16 and openings 14 can be utilized, including two flanges 16/openings 14, one flange 16/opening 14, or more than three flanges 16/openings 14 so that the binding mechanism 10 can be shaped and configured as desired to match the configuration of the item desired to be bound.

Having described the invention in detail and by reference to the various embodiments, it should be understood that modifications and variations thereof are possible without departing from the scope of the invention.

What is claimed is:

1. A binding mechanism comprising:

a body portion including a flange opening extending therethrough;

a manually deflectable flange coupled to said body portion, wherein at least part of said flange is insertable through said flange opening from a first side of said body portion to at least partially form a loop on said first side of said body portion, and wherein said at least part of said flange is alternatively insertable through said flange opening from a second side of said body portion opposite said first side to at least partially form a loop on said second side of said body portion, wherein said body portion includes or at least partially defines a body portion opening positioned adjacent a base end of said flange, and wherein said body portion opening is configured to receive said flange therethrough to enable said flange to be positioned on said second side of said body portion; and a storage device, wherein said body portion is directly coupled to said storage device such that said body portion opening is positioned between said body portion and said storage device.

2. The binding mechanism of claim 1 wherein said body portion and said flange are formed from a single, unitary piece of material.

3. The binding mechanism of claim 1 wherein said loop is entirely formed by said flange and said body portion.

4. The binding mechanism of claim 1 wherein said flange is made from a different piece of material than said storage device.

5. The binding mechanism of claim 1 wherein said flange includes a stem portion and a tip portion at or adjacent to a distal end thereof, at least part of said tip portion having a greater width than said stem portion, wherein said width extends in a direction perpendicular to a length of said stem portion.

6. The binding mechanism of claim 5 wherein a base end of said tip portion is defined by a stop surface extending generally perpendicular to said length of said stem portion.

7. The binding mechanism of claim 5 wherein said flange opening has a maximum width portion about equal to or larger than a maximum width of said tip portion and wherein said flange opening has a minimum width portion smaller than said maximum width of said tip portion such that said tip portion must be misaligned with said minimum width portion of said flange opening for said tip portion to be received through said flange opening.

8. The binding mechanism of claim 7 wherein said flange is manually twistable such that said tip portion can be selectively aligned or misaligned with said maximum width portion of said flange opening by manually twisting said flange.

9. The binding mechanism of claim 8 wherein in the absence of outside twisting forces said flange resides in a position wherein said maximum width of said tip portion is aligned with said minimum width portion of said flange opening and wherein said flange is manually twistable such that said maximum width of said tip portion is misaligned with said minimum width portion of said flange opening.

10. The binding mechanism of claim 1 wherein said body portion includes a first and a second supplemental flange opening and wherein the binding mechanism further comprises a first and a second supplemental flange coupled to said body portion, wherein at least part of each first and second supplemental flange is insertable through an associated first and second supplemental flange opening from said first side of said body portion to form first and second supplemental loops on said first side of said body portion, and wherein at least part of each first and second supplemental flange is alternatively insertable through said associated first and second supplemental flange opening from said second side of said body portion opposite said first side to form said first and second supplemental loops on said second side of said body portion.

11. The binding mechanism of claim 1 wherein a base portion of said flange is positioned between said flange opening and said body portion opening.

12. The binding mechanism of claim 1 wherein a base portion of said flange is positioned immediately adjacent to said body portion opening.

13. The binding mechanism of claim 1 wherein said storage device is a single continuous structure.

14. The binding mechanism of claim 1 wherein said body portion is adhered to said storage device.

15. The binding mechanism of claim 1 wherein said storage device includes a front cover and a rear cover directly or indirectly hingedly coupled to said front cover.

16. The binding mechanism of claim 15 wherein said front cover is directly coupled to said rear cover.

17. A binding mechanism comprising:

a body portion including a flange opening extending therethrough; and a manually deflectable flange coupled to said body portion, wherein at least part of said flange is insertable through said flange opening from a first side of said body portion to at least partially form a loop on said first side of said body portion, and wherein said at least part of said flange is alternatively insertable through said flange opening from a second side of said body portion opposite said first side to at least partially form a loop on said second side of said body portion, wherein said body portion includes or at least partially defines a body portion opening positioned adjacent a base end of said flange, wherein said body portion opening is configured to receive said flange therethrough to enable said flange to be positioned on said second side of said body portion, wherein said body portion is generally flat and sheet-like, and wherein the body portion includes a binding mechanism hinge line dividing said body portion into a first portion and a second portion.

18. The binding mechanism of claim 17 wherein said flange is coupled to said first portion of said body portion, and wherein said first portion includes at least part of said body portion opening.

19. The binding mechanism of claim 18 further comprising a storage device including a front cover and a rear cover hingedly coupled to said front cover along a storage device hinge line, and wherein said second portion of said body portion is fixedly coupled to said storage device, and wherein said binding mechanism hinge line is aligned with or positioned adjacent to said storage device hinge line.

20. The binding mechanism of claim 19 wherein said first portion is pivotable about said binding mechanism hinge line relative to said storage device.

21. The binding mechanism of claim 17 wherein said flange opening is positioned in said first portion.

22. A binding mechanism comprising:

a body portion including a flange opening;

a flange directly and nonslidably coupled to said body portion, wherein a distal end of said flange is manually insertable through said flange opening to form at least part of a loop on a first side of said body portion, and wherein said distal end of said flange is manually insertable through said flange opening to form at least part of a loop on a second side of said body portion; and a storage device, wherein said body portion is coupled to said storage device and a body portion opening is positioned generally between said body portion and said storage device, and wherein the body portion opening is positioned between a distal end of said flange and said flange opening along a direction of a length of said flange when said flange is not forming said loop.

23. The binding mechanism of claim 22 wherein said body portion includes or at least partially defines said body portion opening positioned adjacent a base end of said flange, wherein said body portion opening is configured to receive said flange therethrough to enable said flange to be positioned on said second side of said body portion.

24. The binding mechanism of claim 22 wherein a base portion of said flange is positioned between said flange opening and said body portion opening.

25. The binding mechanism of claim 22 wherein said body portion and said flange are formed from a single, unitary piece of material.

26. The binding mechanism of claim 22 wherein said storage device includes a front cover and a rear cover directly or indirectly hingedly coupled to said front cover.

27. A method for manipulating a binding mechanism comprising:

accessing a binding mechanism including a body portion having a flange opening extending therethrough, the binding mechanism further including a manually deflectable flange directly and nonslidably coupled to said body portion;

inserting at least part of said flange through said flange opening from a first side of said body portion to form a first loop on said first side of said body portion;

retracting said at least part of said flange from said flange opening;

passing at least part of said flange through a body portion opening; and inserting said at least part of said flange through said flange opening from a second side of said body portion opposite said first side to form a second loop on said second side of said body portion.

28. The method of claim 27 wherein the binding mechanism includes a cover coupled to said body portion, and wherein the body portion opening is positioned between a base portion of said flange and said cover.

29. The method of claim 27 wherein the manually deflectable flange is formed from a unitary piece of material with the body portion.

* * * * *